US012115618B2

(12) United States Patent
Chen et al.

(10) Patent No.: US 12,115,618 B2
(45) Date of Patent: Oct. 15, 2024

(54) BELT SANDER

(71) Applicant: BASSO INDUSTRY CORP., Taichung (TW)

(72) Inventors: Yu-Da Chen, Taichung (TW); Ching-Chih Ho, Taichung (TW); Bo-Jhuang Chen, Taichung (TW); Yu-Ming Chan, Taichung (TW); Min-Hsu Tsai, Taichung (TW)

(73) Assignee: Basso Industry Corp., Taichung (TW)

( * ) Notice: Subject to any disclaimer, the term of this patent is extended or adjusted under 35 U.S.C. 154(b) by 400 days.

(21) Appl. No.: 17/737,657

(22) Filed: May 5, 2022

(65) Prior Publication Data

US 2022/0362901 A1 Nov. 17, 2022

(30) Foreign Application Priority Data

May 14, 2021 (TW) ..... 110117525

(51) Int. Cl.
*B24B 23/06* (2006.01)
*B24B 27/00* (2006.01)
*B24B 55/00* (2006.01)

(52) U.S. Cl.
CPC ..... *B24B 23/06* (2013.01); *B24B 55/00* (2013.01); *B24B 27/0084* (2013.01)

(58) Field of Classification Search
CPC ..... B24B 23/06; B24B 27/0084; B24B 21/18; B24B 21/00; B24B 55/00; B25F 5/02
USPC ..... 451/296, 310, 355
See application file for complete search history.

(56) References Cited

U.S. PATENT DOCUMENTS 10,137,554 B2 * 11/2018 Hsu ..... B24B 23/005
2018/0093359 A1 4/2018 Johnson et al.

FOREIGN PATENT DOCUMENTS

| | | | |
|---|---|---|---|
| CN | 112775794 | A | 5/2021 |
| DE | 102020006659 | A1 | 5/2021 |
| JP | 2006130640 | A | 5/2006 |
| TW | M422448 | U | 2/2012 |
| TW | M436529 | U | 9/2012 |
| TW | 201639662 | A | 11/2016 |
| TW | I593506 | B | 8/2017 |

OTHER PUBLICATIONS

Search Report issued to European counterpart application No. 22172747.2 by the EPO on Oct. 11, 2022.
Search Report appended to an Office Action, which was issued to Taiwanese counterpart application No. 110117525 by the TIPO on Mar. 8, 2024, with an English translation thereof.

* cited by examiner

*Primary Examiner* — Makena S Markman
(74) *Attorney, Agent, or Firm* — Burris Law, PLLC

(57) ABSTRACT

A belt sander includes a main casing, a frame arm rotatably connected to the main casing, an abrasive belt mounted to the frame arm and adapted to be driven by electric power, a positioning member, a first sensor and a second sensor. The positioning member is movably mounted to the main casing and is movable relative to the main casing between a releasing position, where the first and second sensors are in a first sensor state, and where the second sensor generates a first signal for ceasing the electric power, and a first engaging position, where the first and second sensors are in the second sensor state, and where the second sensor generates a second signal for conducting the electric power.

12 Claims, 19 Drawing Sheets

BELT SANDER

CROSS-REFERENCE TO RELATED APPLICATION

This application claims priority to Taiwanese Invention Patent Application No. 110117525, filed on May 14, 2021.

FIELD

The disclosure relates to a sander, and more particularly to a belt sander.

BACKGROUND

Referring to FIG. 1, a conventional hand-held belt sander 1 disclosed in Taiwanese Invention Patent No. I593506 includes a casing 11, an arm 12, an actuator 13 and a sensor 14. The arm 12 is rotatable relative to the casing 11 between a working state and a storage state. The actuator 13 is disposed in the arm 12. The sensor 14 is disposed in the casing 11. The arm 12 includes a sanding belt 121 that is used for grinding workpieces. When the arm 12 is in the working state, the actuator 13 is kept away from the sensor 14, and the sanding belt 121 is actuatable by electric power. When the arm 12 is in the storage state, the actuator 13 is close to the sensor 14, and the sensor 14 senses the actuator 13 contactlessly, or through contact. When the sensor 14 senses the actuator 13, the sensor 14 generates a control signal that cuts off the electric power. Consequently, the sanding belt 121 cannot be actuated when the arm 12 is in the storage state (i.e., when the actuator 13 is close to the sensor 14), which guarantees user's safety when the conventional hand-held belt sander 1 is stored.

However, the safety is only guaranteed when the conventional hand-held belt sander 1 is stored. If a user adjusts the arm 12 to a desired operating position relative to the casing 11 with his/her hand when the arm 12 is in the working state, the sanding belt 121 which has not ceased operation may cause harm to the user's hand. Furthermore, because the actuator 13 is disposed in the arm 12, the actuator 13 can only be sensed by the sensor 14 to cut off the electric power when the arm 12 is rotated to a specific position relative to the casing 11.

SUMMARY

Therefore, an object of the disclosure is to provide a belt sander that can achieve at least one more effect than the prior art.

According to the disclosure, the belt sander includes a main casing, a belt unit, a positioning unit and a sensor unit. The belt unit includes a frame arm that is rotatably connected to the main casing, and an abrasive belt that is mounted to the frame arm and that is adapted to be driven by electric power. The positioning unit includes a positioning member that is movably mounted to the main casing, and an engaging member that is co-movably connected to the positioning member. The positioning member is movable relative to the main casing between a first engaging position, where the engaging member engages the frame arm such that the frame arm is prevented from rotating, and a releasing position, where the engaging member is disengaged from the frame arm such that the frame arm is allowed to rotate. The sensor unit includes a first sensor and a second sensor. The first sensor is mounted to the main casing. The second sensor is connected to one of the positioning member and the engaging member, and is co-movable with the one of the positioning member and the engaging member relative to the first sensor. The first and second sensors are convertible between a first sensor state and a second sensor state. When the positioning member is at the releasing position, the first and second sensors are in the first sensor state, and the second sensor generates a first signal for ceasing the electric power. When the positioning member is at the first engaging position, the first and second sensors are in the second sensor state, and the second sensor generates a second signal for conducting the electric power.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
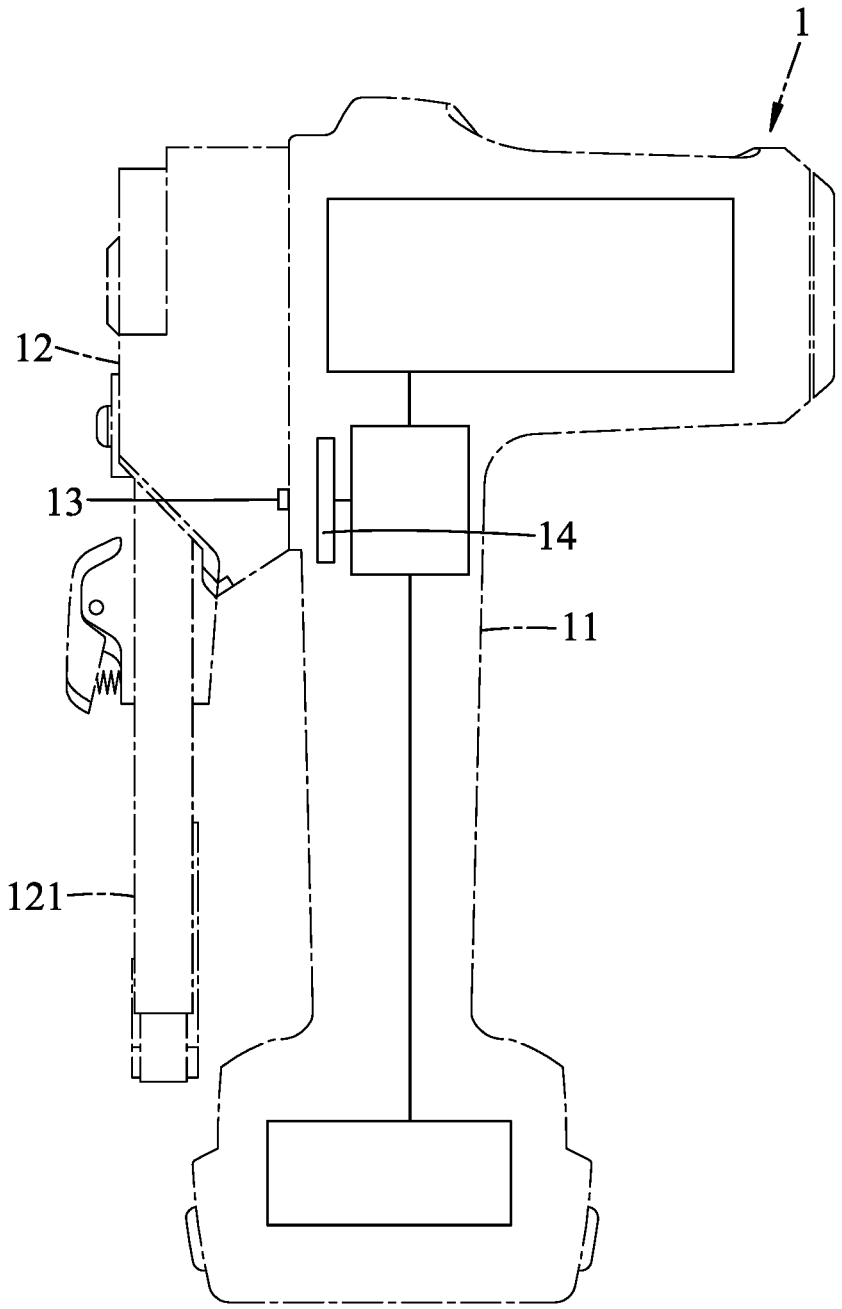
FIG.1 PRIOR ART
FIG. 1 is a schematic view of a conventional belt sander disclosed in Taiwanese Invention Patent No. I593506.
Figure 2:
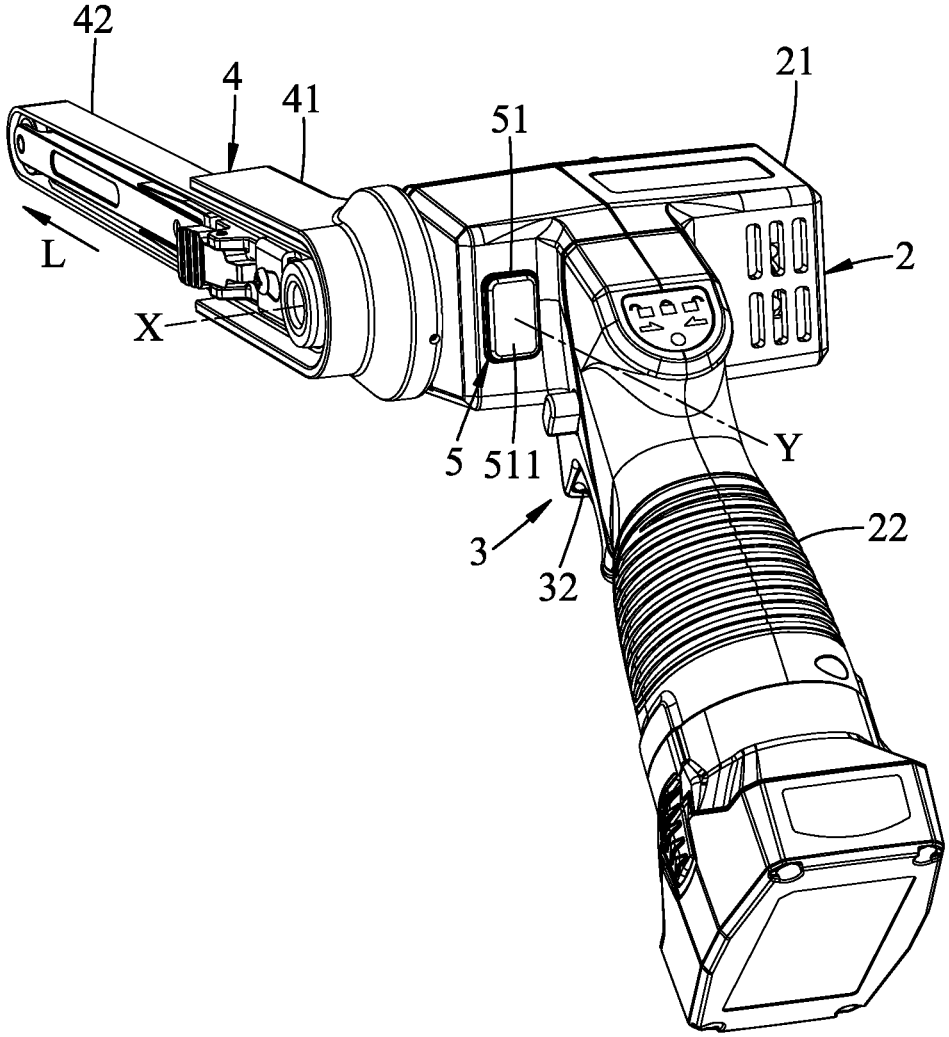
FIG. 2 is a perspective view of an embodiment of a belt sander according to the disclosure.

Referring to FIGS. 2 to 5, an embodiment of a belt sander according to the disclosure includes a main casing 2, a power unit 3, a belt unit 4, a positioning unit 5 and a sensor unit 6.

The main casing 2 includes a main portion 21 and a handle portion 22. The main portion 21 surrounds a first axis (X), defines a receiving space 20, and has a channel 211 and a mounting surface 212 (see FIG. 10). The channel 211 extends from an outer surface of the main portion 21 to an inner surface of the main portion 21, and spatially communicates with the receiving space 20. The mounting surface 212 is spaced apart from the belt unit 4. In this embodiment, the channel 211 extends along a second axis (Y) which is substantially perpendicular to the first axis (X). The handle portion 22 is transversely connected to the main portion 21, extends from the outer surface of the main portion 21, and is adjacent to the channel 211.

Figure 7:
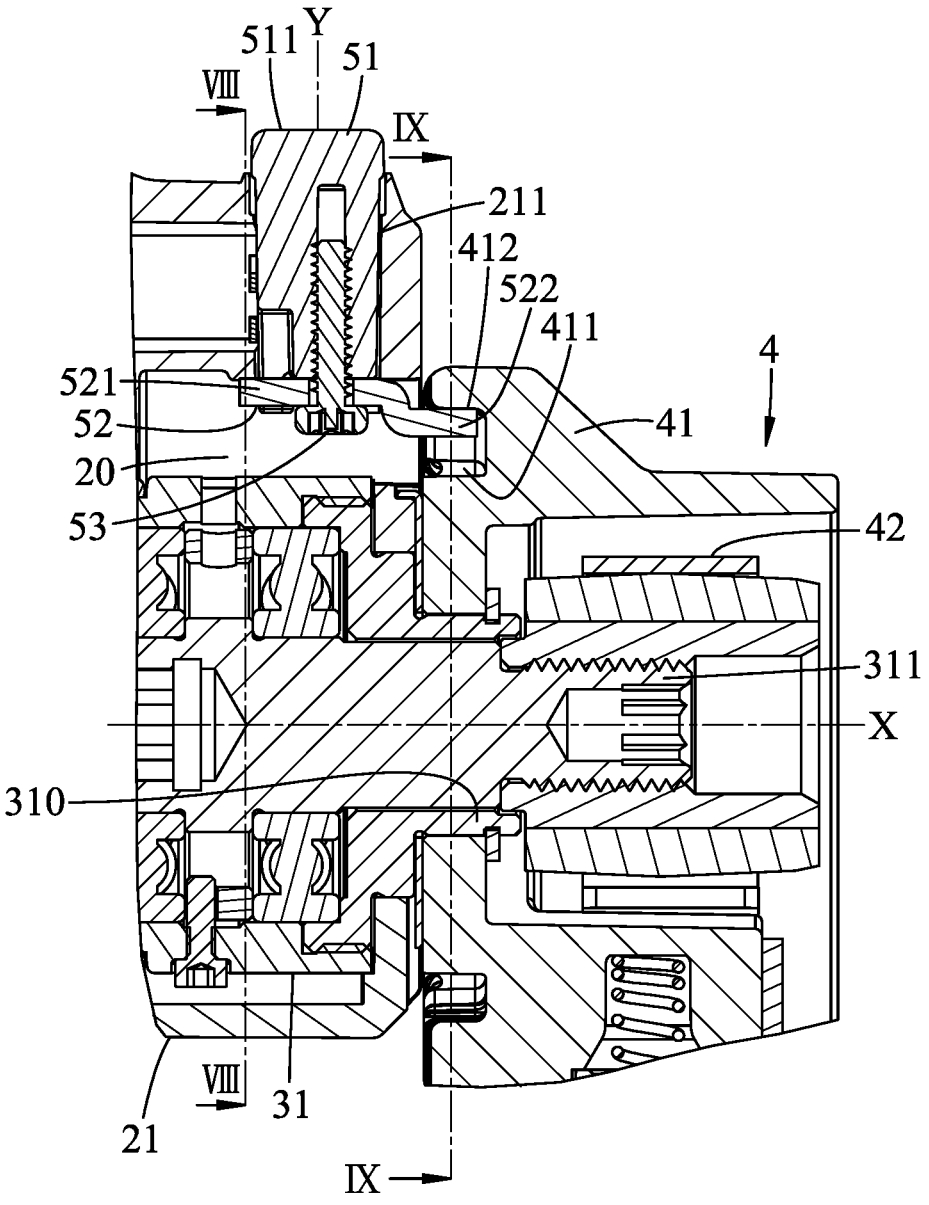
FIG. 7 is a fragmentary sectional view taken along line VII-VII in FIG. 6, illustrating a positioning member of the embodiment at a first engaging position.

The power unit 3 is mounted to the main casing 2, and includes a motor 31, a trigger subunit 32 and an electrical control subunit 33. The motor 31 is mounted to the main portion 21 of the main casing 2 and is located in the receiving space 20 of the main portion 21. The trigger subunit 32 is mounted to the handle portion 22 of the main casing 2, is electrically coupled to the motor 31, and is adapted for manual operation so as to generate a trigger signal (S). The electrical control subunit 33 is mounted to the main portion 21, and is electrically coupled to the motor 31 and the trigger subunit 32 for receiving the trigger signal (S). The motor 31 includes an annular portion 310 (see FIG. 7) and a rotating shaft 311. The annular portion 310 surrounds the first axis (X) and extends out of the main portion 21 of the main casing 2. The rotating shaft 311 is surrounded by the annular portion 310, is driven by electric power, and is rotatable about the first axis (X). The electrical control subunit 33 is used to stop the electric power from being delivered to the motor 31, and to allow the electric power to be delivered to the motor 31, so as to turn off and turn on the motor 31. When the electric power is allowed to be delivered to the motor 31 (i.e. the motor 31 is on), the electrical control subunit 33 further drives the rotating shaft 311 to rotate by the electric power.

The belt unit 4 is substantially perpendicular to the direction of the first axis (X), and includes a frame arm 41 and an abrasive belt 42. The frame arm 41 is rotatably connected to the main casing 2, and is rotatably coupled to the annular portion 310 of the motor 31. The abrasive belt 42 is mounted to the frame arm 41 and is adapted to be driven by the electric power. Specifically, the rotating shaft 311 of the motor 31 drives the abrasive belt 42 to spin by the electric power.

Figure 6:
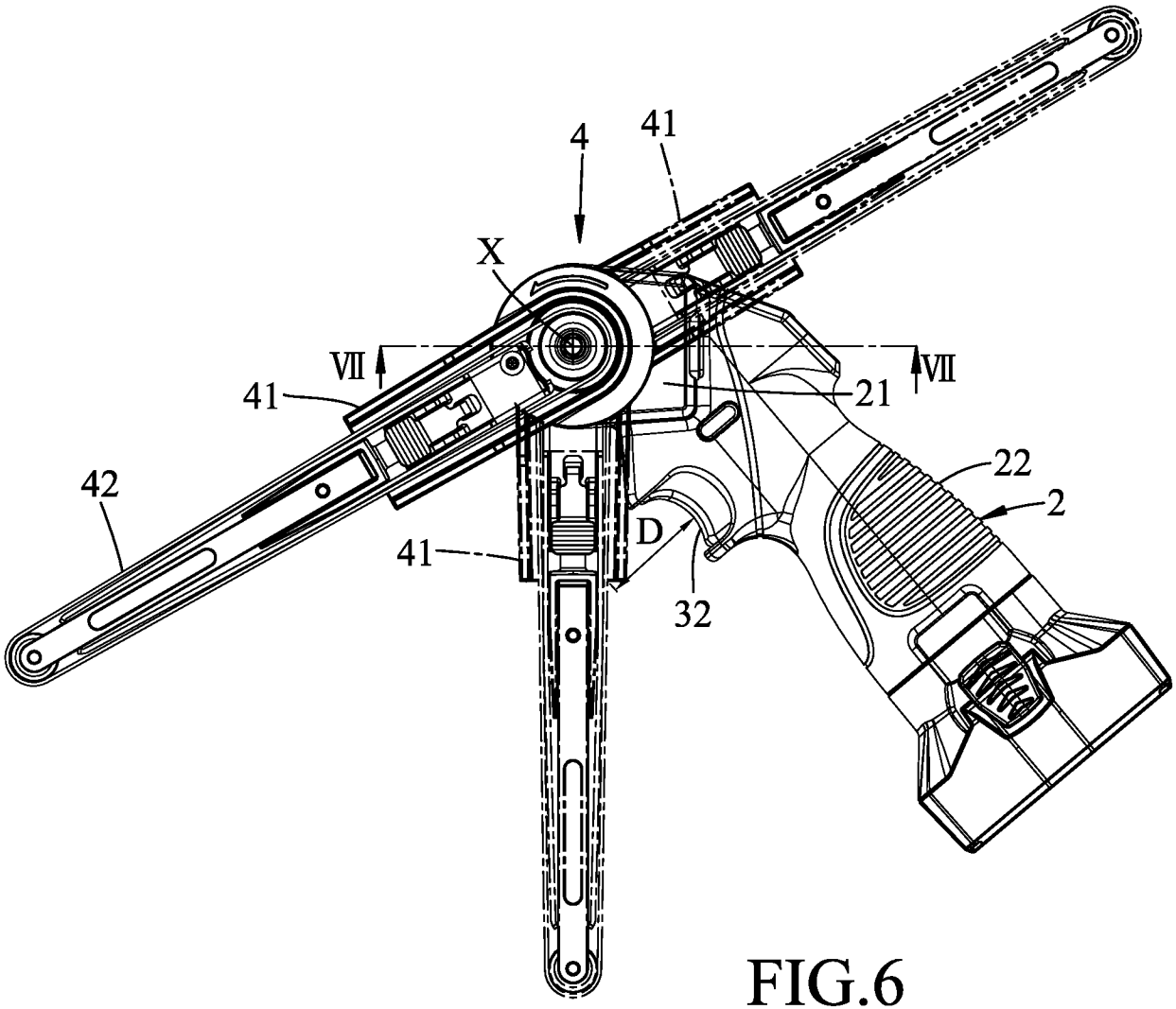
FIG. 6 is a schematic side view illustrating the frame arm rotating between a working state and a storage state.

Referring further to FIG. 6, the frame arm 41 and the handle portion 22 of the main casing 2 cooperatively define an included angle on an imaginary plane (not shown) perpendicular to the first axis (X). The included angle changes as the frame arm 41 rotates relative to the main casing 2. The frame arm 41 is formed with a track groove 411 that opens toward the main casing 2 and that surrounds the first axis (X) and the rotating shaft 311 of the motor 31, and a plurality of first notches 412 and a plurality of second notches 413 that are arranged around the track groove 411 and that are in spatial communication with the track groove 411. The frame arm 41 is rotatable relative to the handle portion 22 of the main casing 2 between a working state (see the frame arm 41 depicted by solid lines in FIG. 6), in which a shortest distance (D) between the abrasive belt 42 thereof and the trigger subunit 32 of the power unit 3 is no less than a safety length, and a storage state (see the frame arm 41 depicted by dot-dash broken lines in FIG. 6), in which the shortest distance (D) between the abrasive belt 42 and the trigger subunit 32 is smaller than the safety length. In this embodiment, the safety length ranges from 70 to 90 millimeters. According to the Belt Sander Safety Standard Specification, the safety length is preferably 80 millimeters.

In this embodiment, the positioning unit 5 is mounted to the main portion 21 of the main casing 2, and includes a bolt 53, two resilient members 54, a positioning member 51 that is movably mounted to the main casing 2, and an engaging member 52 that is co-movably connected to the positioning member 51.

The positioning member 51 is elongated along the second axis (Y), is disposed in the channel 211 of the main portion 21 of the main casing 2, is movable relative to the main casing 2 along the second axis (Y), and has a pressing surface 511 that is exposed from the channel 211 for manual operation.

The engaging member 52 is elongated in the direction of the first axis (X), and has a connection portion 521, and an engaging portion 522 that is opposite to the connection portion 521.

The bolt 53 extends through the connection portion 521 of the engaging member 52, is connected to the positioning member 51, and fastens the engaging member 52 to the positioning member 51 so that the engaging member 52 is co-movable with the positioning member 51.

Figure 11:
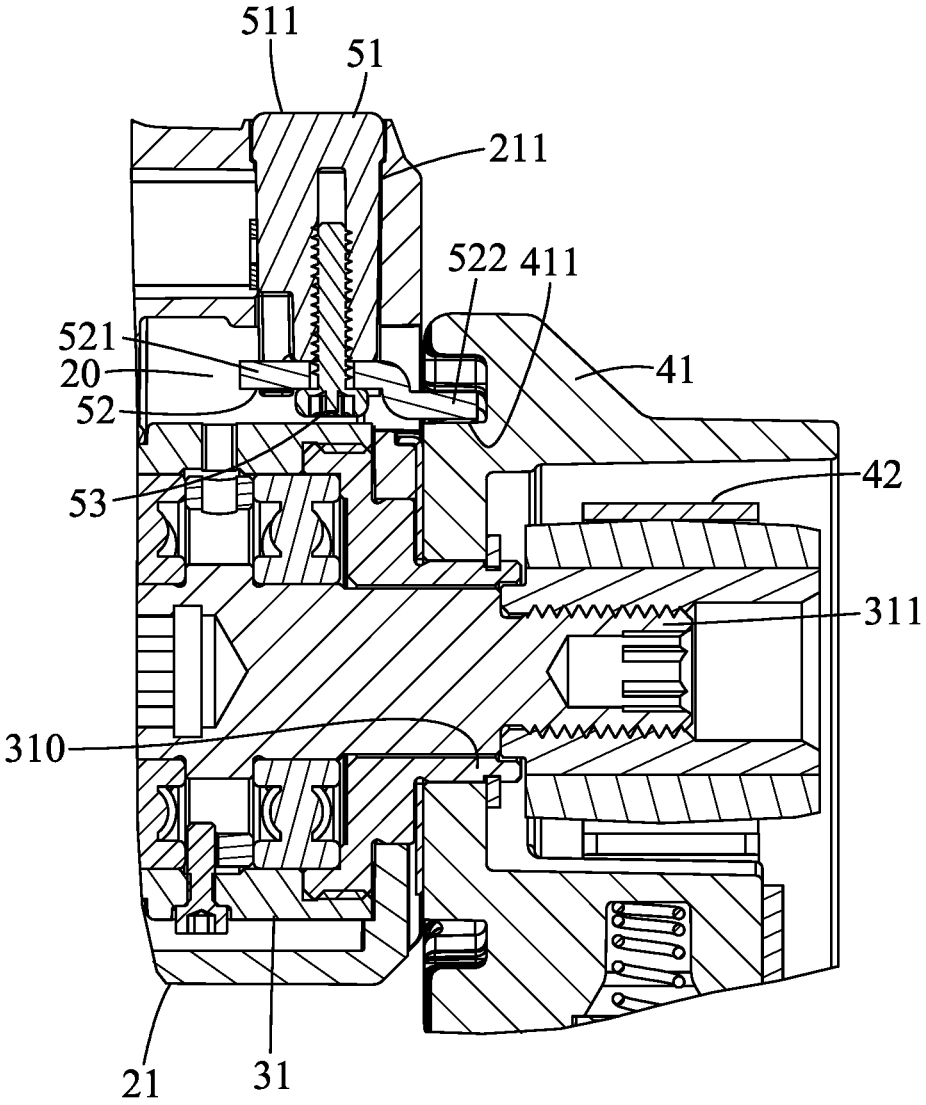
FIG. 11 is a view similar to FIG. 7, but illustrating that the positioning member is at a releasing position.
Figure 14:
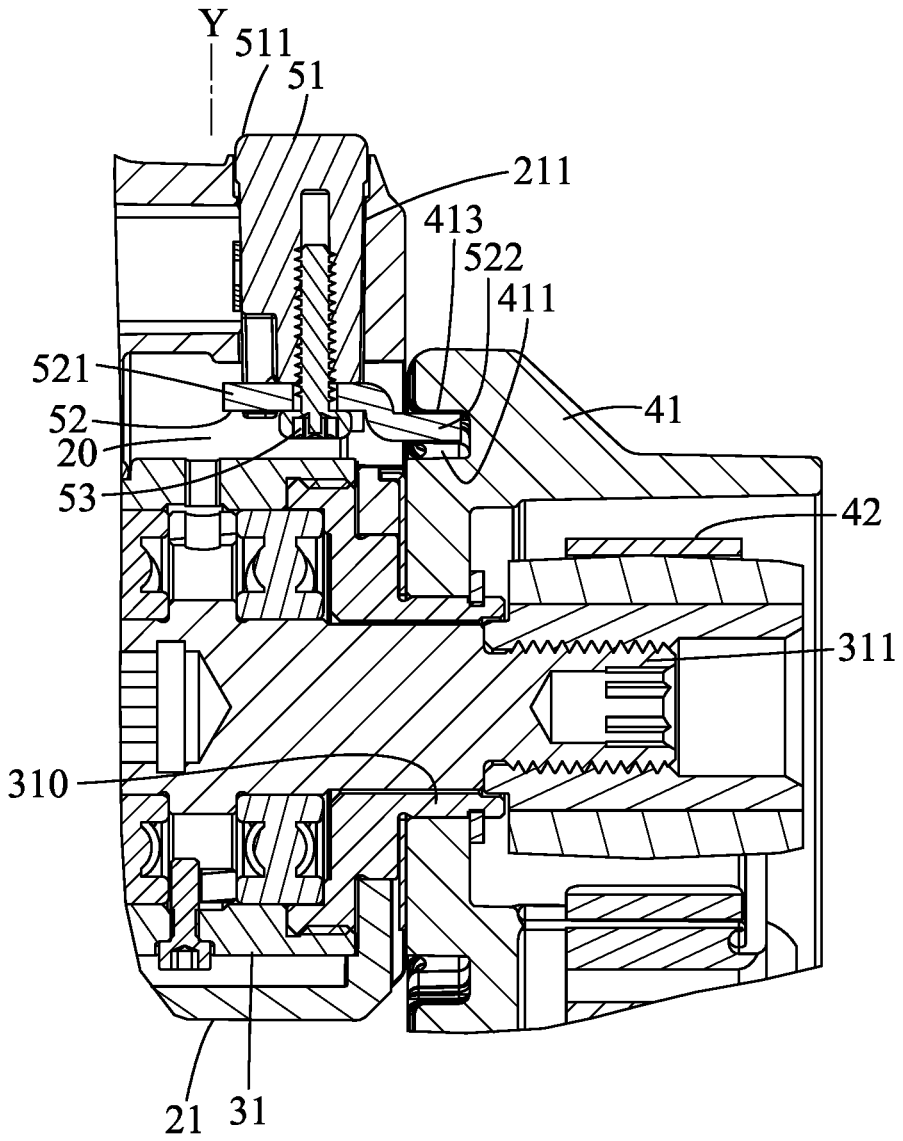
FIG. 14 is a view similar to FIG. 7, but illustrating that the positioning member is at a second engaging position.

In this embodiment, the positioning member 51 is movable relative to the main casing 2 along the second axis (Y) among a releasing position (see FIG. 11), a first engaging position (see FIG. 7) and a second engaging position (see FIG. 14). When the positioning member 51 is at the releasing position, the engaging portion 522 of the engaging member 52 extends into the track groove 411 of the frame arm 41. At this time, the engaging member 52 is disengaged from the frame arm 41 such that the frame arm 41 is allowed to rotate relative to the main casing 2 between the working state and the storage state. When the positioning member 51 is at the first engaging position, the engaging portion 522 of the engaging member 52 extends into a selected one of the first notches 412 of the frame arm 41 to engage the frame arm 41 such that the frame arm 41 is positioned in the working state and is prevented from rotating. When the positioning member 51 is at the second engaging position, the engaging portion 522 of the engaging member 52 extends into a selected one of the second notches 413 of the frame arm 41 to engage the frame arm 41, such that the frame arm 41 is positioned in the storage state and is prevented from rotating.

Figure 8:
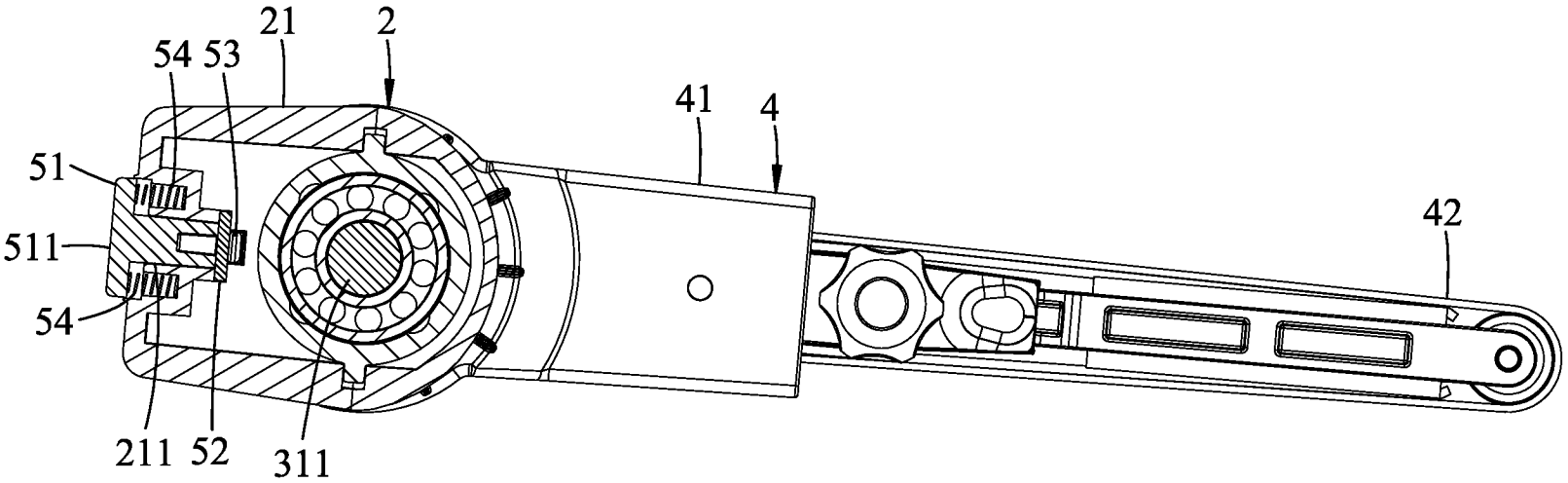
FIG. 8 is a sectional view taken along line VIII-VIII in FIG. 7, illustrating resilient members of the embodiment biasing the positioning member.

Referring further to FIG. 8, each of the resilient members 54 is disposed between and abuts against the positioning member 51 and the main portion 21 of the main casing 2 for biasing the positioning member 51 away from the releasing position.

Figure 3:
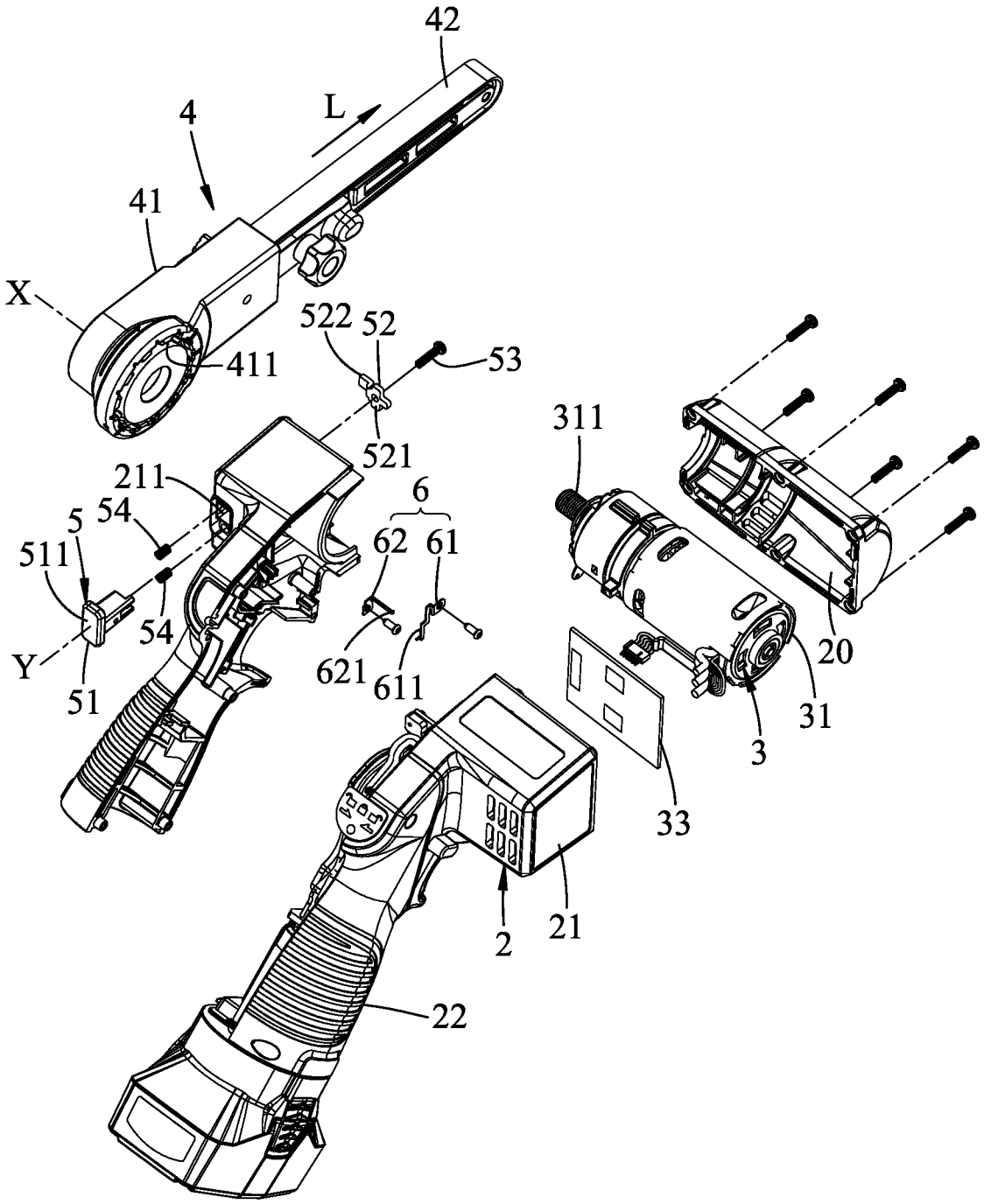
FIG. 3 is an exploded perspective view of the embodiment.
Figure 4:
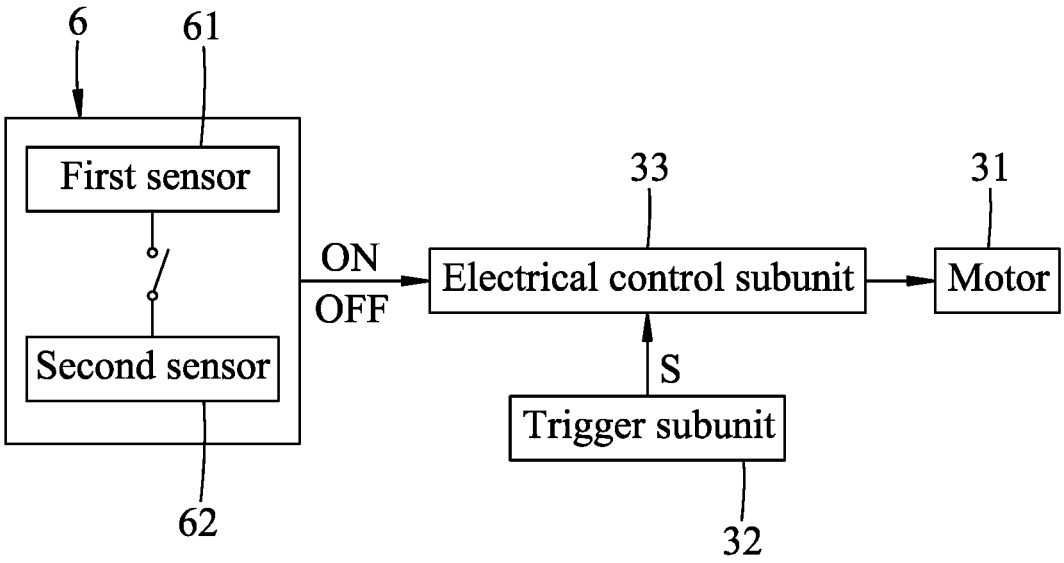
FIG. 4 is a flowchart illustrating the electrical control of the embodiment.
Figure 5:
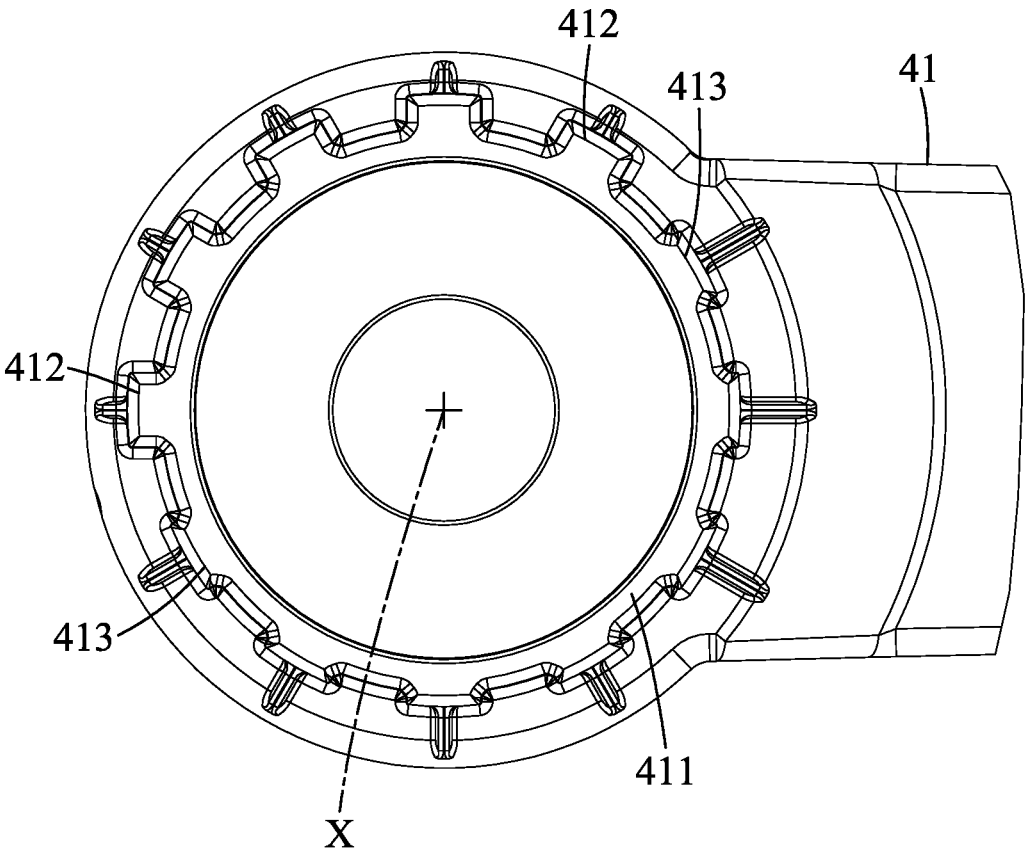
FIG. 5 is a side view of a frame arm of the embodiment taken in the direction of a first axis.
Figure 9:
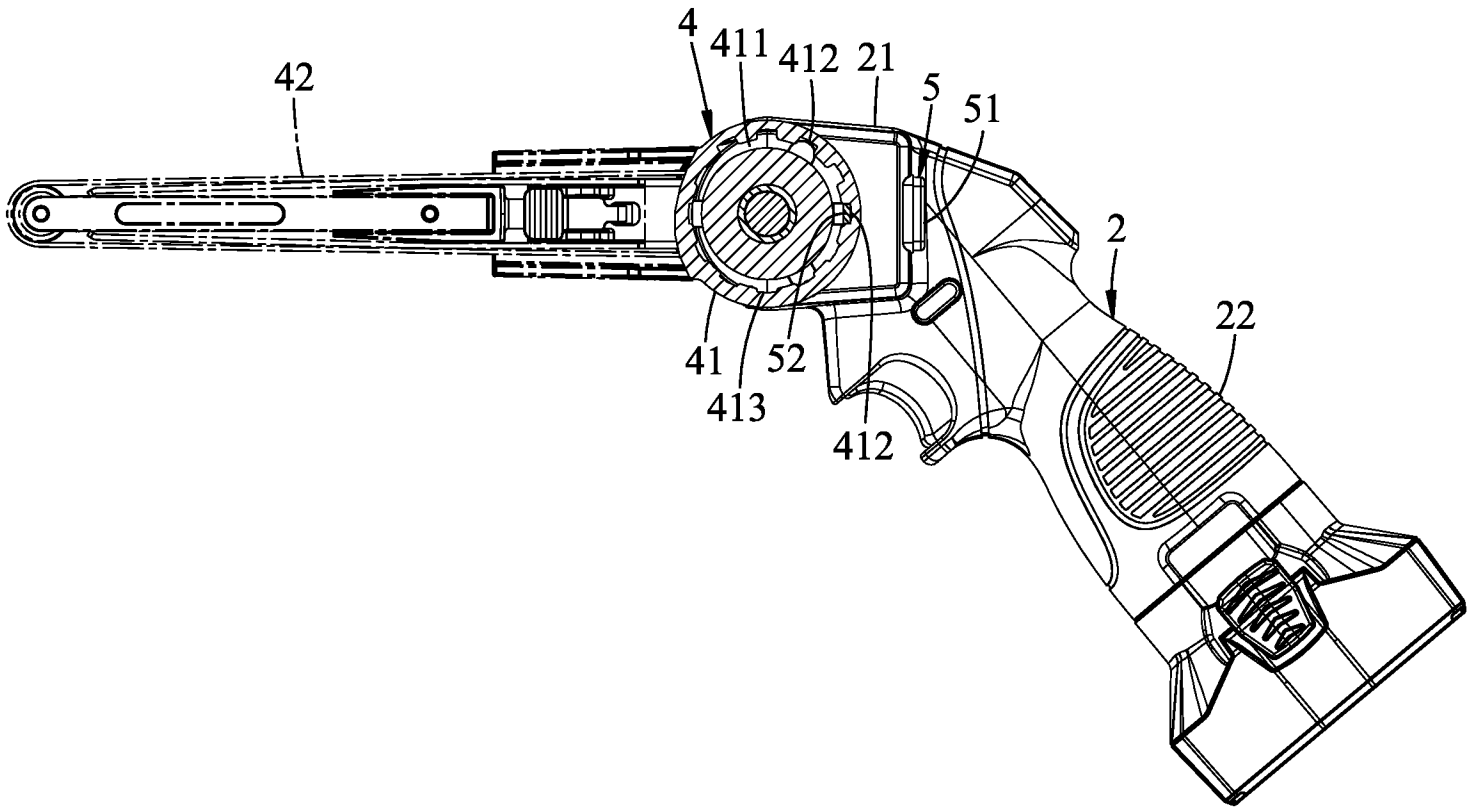
FIG. 9 is a sectional view taken along line IX-IX in FIG. 7, illustrating an engaging member of the embodiment extending into one of first notches of the frame arm.
Figure 10:
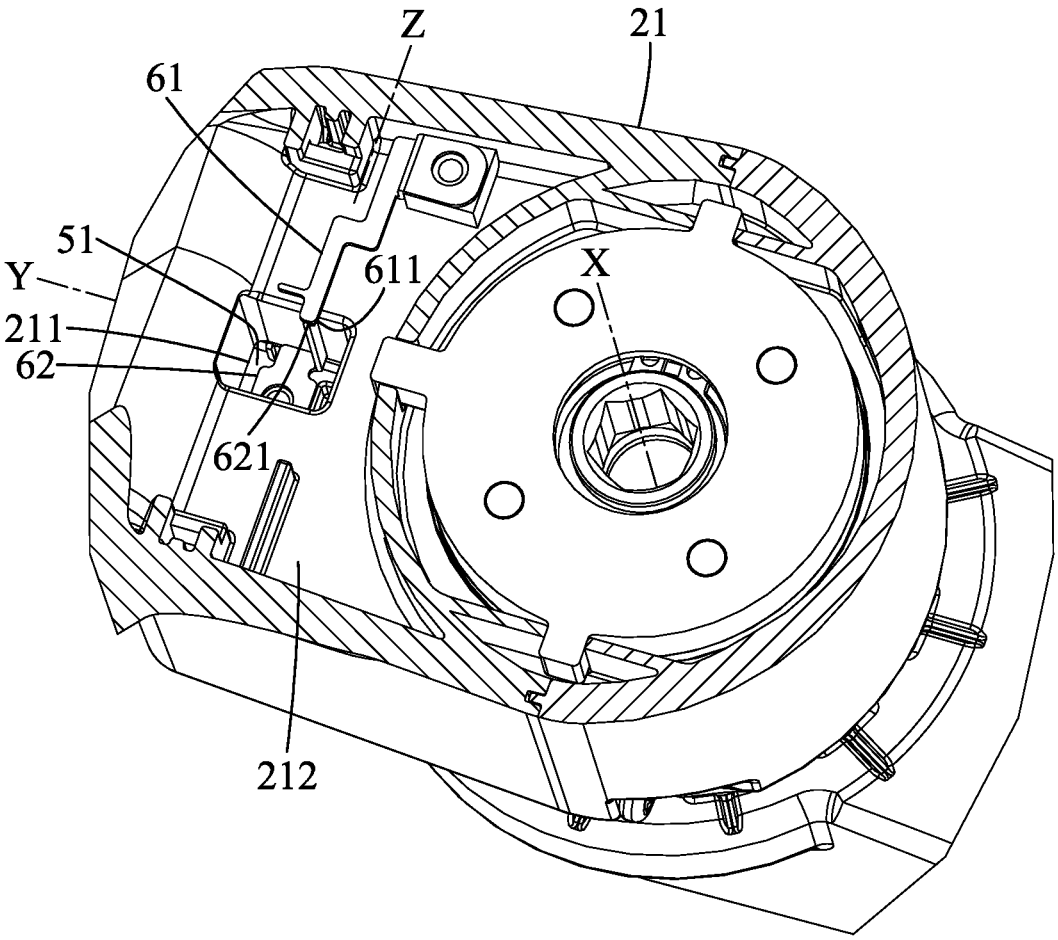
FIG. 10 is a fragmentary perspective partly cutaway view illustrating a second sensor of the embodiment being in contact with a first sensor of the embodiment.

Referring further to FIG. 9, in cooperation with FIGS. 3, 4 and 10, the sensor unit 6 includes a first sensor 61 that is mounted to the mounting surface 212 of the main casing 2 and that is electrically coupled to the electrical control subunit 33 of the power unit 3, and a second sensor that is electrically coupled to the electrical control subunit 33. The first sensor 61 is elongated along a third axis (Z) that is substantially perpendicular to the first axis (X) and the second axis (Y), is adjacent to the channel 211 of the main portion 21, and has a sensor surface 611 that faces the channel 211. In this embodiment, the second sensor 62 is connected to the positioning member 51 of the positioning unit 5, is elongated in the direction of the first axis (X), and has a sensor surface 621.

Figure 13:
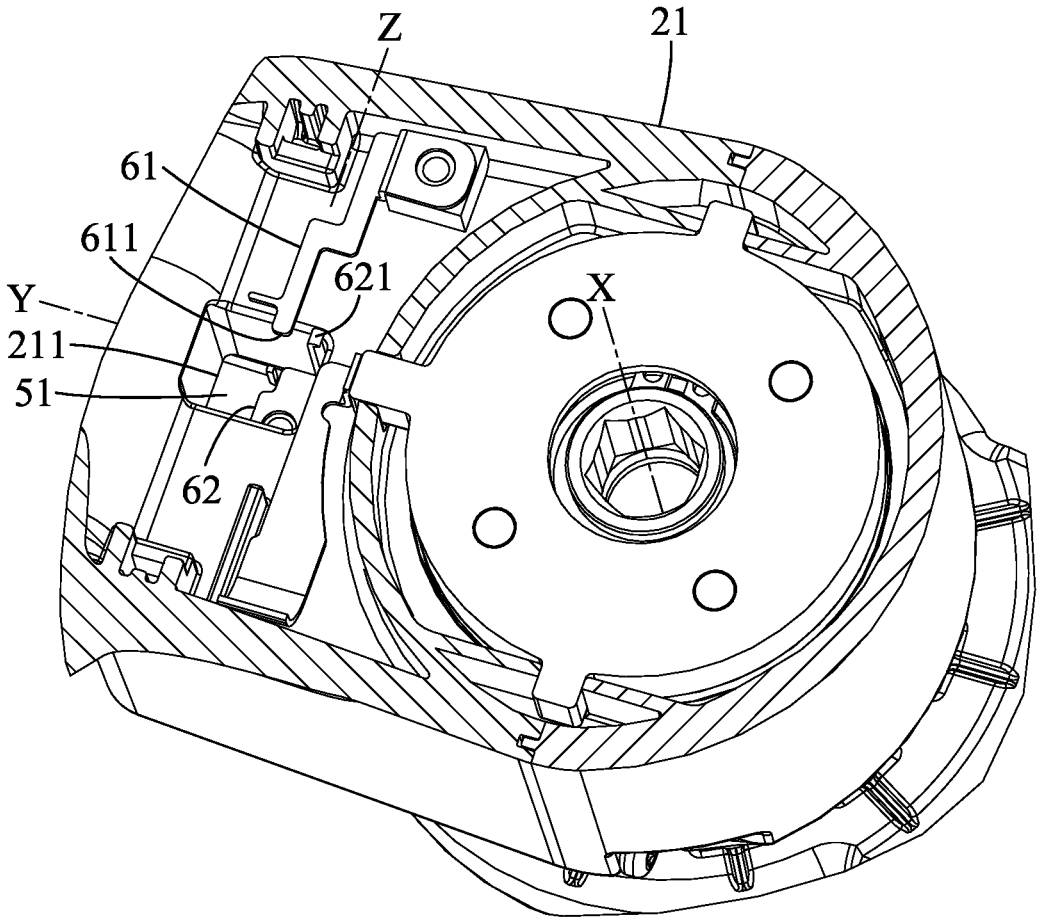
FIG. 13 is a view similar to FIG. 10, but illustrating that the second sensor is separated from the first sensor when the positioning member is at the releasing position.
Figure 16:
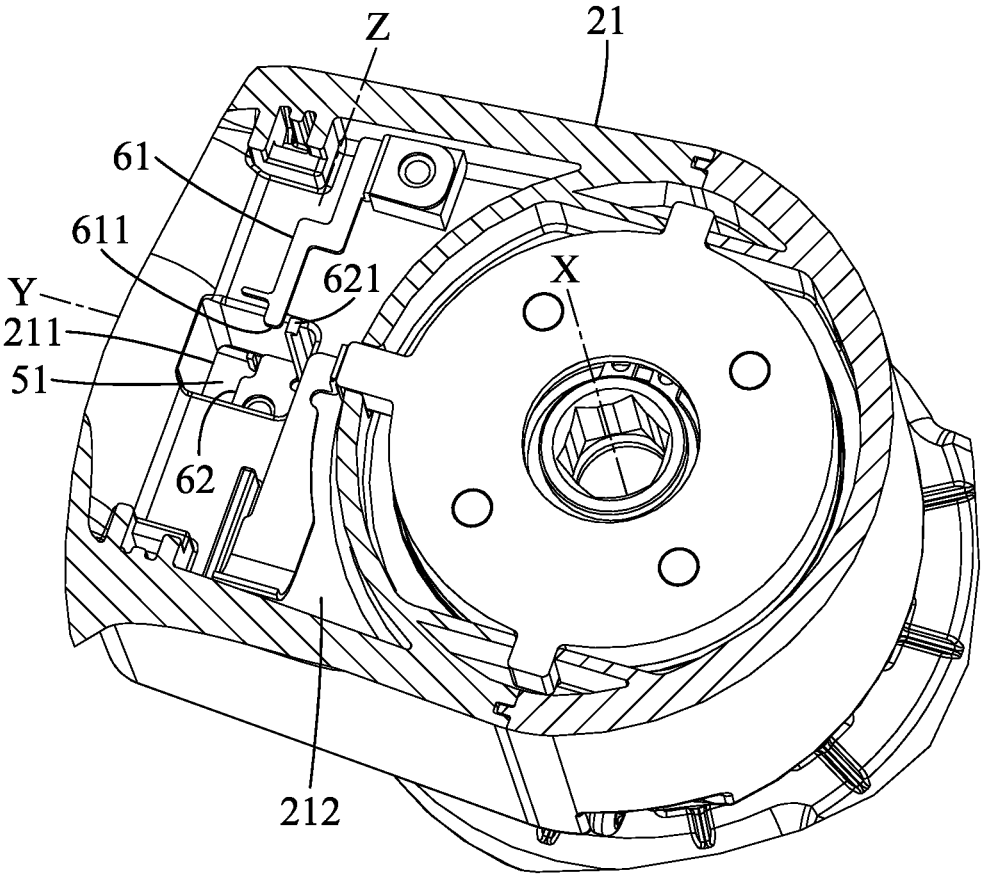
FIG. 16 is a view similar to FIG. 13 illustrating the positioning member at the second engaging position.

The second sensor 62 is co-movable with the positioning member 51 relative to the first sensor 61. The first and second sensors 61, 62 are convertible between a first sensor state (see FIGS. 13 and 16) and a second sensor state (see FIG. 10). In this embodiment, when the positioning member 51 is at the releasing position, the first and second sensors 61, 62 are in the first sensor state, in which the sensor surface 621 of the second sensor 62 is separated from the sensor surface 611 of the first sensor 61, and the second sensor 62 generates a first signal (OFF) for ceasing the electric power. When the positioning member 51 is at the first engaging position, the first and second sensors 61, 62 are in the second sensor state, in which the sensor surface 621 of the second sensor 62 is in contact with the sensor surface 611 of the first sensor 61, and the second sensor 62 generates a second signal (ON) for conducting the electric power. Specifically, the electrical control subunit 33 of the power unit 3 is electrically coupled to the first sensor 61 and the second sensor 62 for receiving the first signal (OFF) and the second signal (ON). The electrical control subunit 33 stops the electric power from being delivered to the motor 31 of the power unit 3 when receiving the first signal (OFF), and allows the electric power to be delivered to the motor 31 when receiving the second signal (ON). In addition, the electrical control subunit 33 allows the electric power to be delivered to the motor 31 when receiving the trigger signal (S) that is generated by the trigger subunit 32 of the power unit 3 upon manual operation.

It is noted that, in one embodiment, the second sensor 62 may be connected to the engaging member 52 to be co-movable with the positioning member 51 relative to the first sensor 61.

Referring to FIGS. 6, 7, 9 and 10 again, when the frame arm 41 is in the working state, and when the positioning member 51 is biased to the first engaging position by the resilient members 54, the engaging portion 522 of the engaging member 52 extends into a selected one of the first notches 412 of the frame arm 41 to engage the frame arm 41 such that the frame arm 41 is positioned in the working state and is prevented from rotating relative to the main casing 2. Referring back to FIG. 4, at this time, the sensor surface 621 of the second sensor 62 is in contact with the sensor surface 611 of the first sensor 61 (i.e., the first and second sensors 61, 62 are in the second sensor state), and the second sensor 62 generates the second signal (ON). When the trigger subunit 32 is operated to generate the trigger signal (S) while the second signal (ON) has been generated by the second sensor 62, the electrical control subunit 33 receives the second signal (ON) and the trigger signal (S), and allows the electric power to be delivered to the motor 31 to further drives the rotating shaft 311 of the motor to rotate by the electric power. The rotating shaft 311 drives the abrasive belt 42 to spin. Consequently, a user can grind or polish an object (not shown) via the spinning abrasive belt 42.

Figure 12:
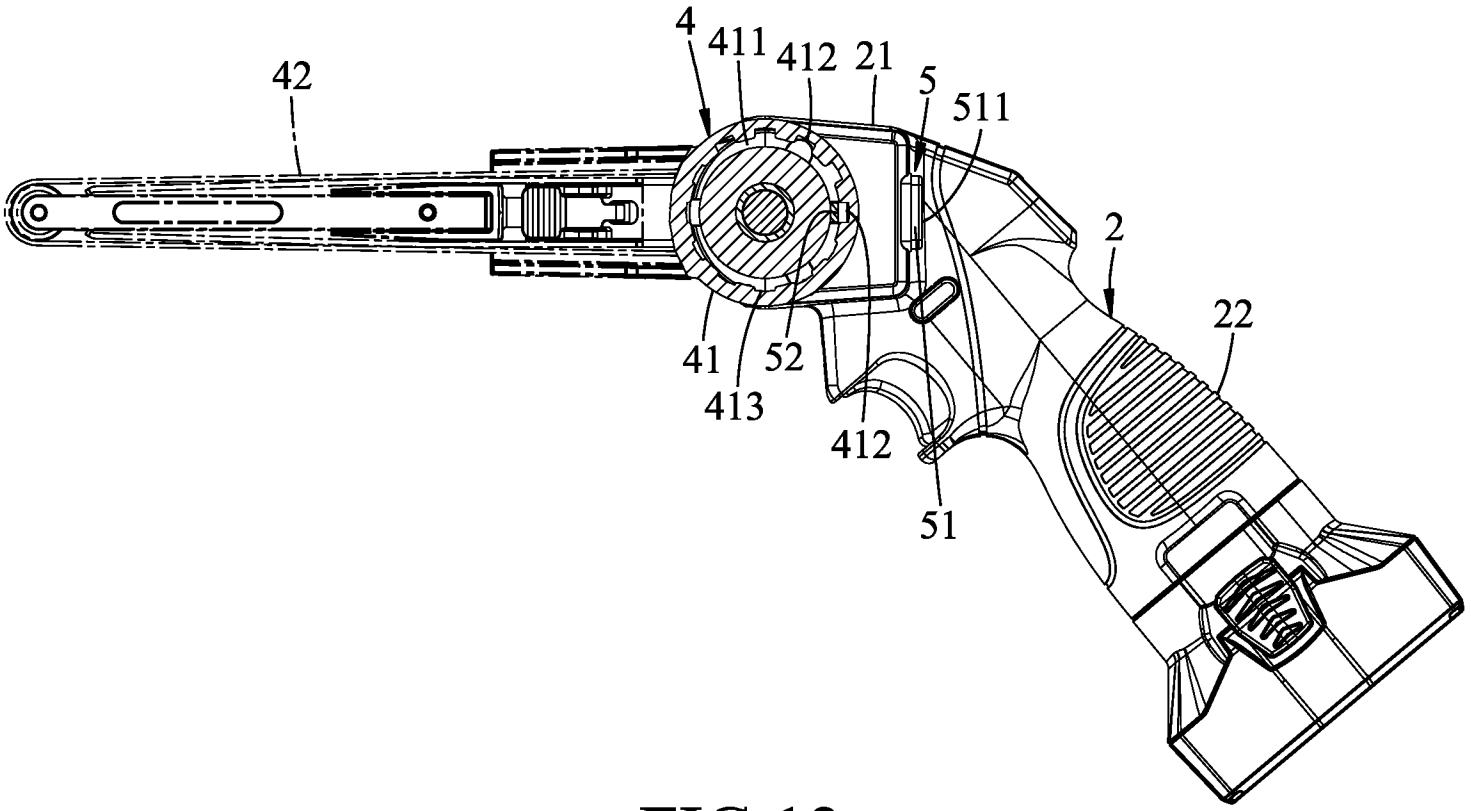
FIG. 12 is a view similar to FIG. 9, but illustrating that the engaging member extends into a track groove of the frame arm.

Referring to FIGS. 11 and 13 again, and further to FIG. 12, the pressing surface 511 of the positioning member 51 is adjacent to the handle portion 22 of the main casing 2. Therefore, when a user needs to adjust the included angle between the frame arm 41 and the handle portion 22 of the main casing 2 (i.e., to adjust the angular position of the frame arm 41), the user can simply press against the pressing surface 511 of the positioning member 51 with his/her finger while his/her hand grips the handle portion 22 of the main casing 2 to push the positioning member 51 toward the releasing position along the second axis (Y). At this time, the resilient members 54 are compressed by the force exerted by the user, and the engaging member 52 is urged to move by the positioning member 51. When the positioning member 51 is at the releasing position, the engaging portion 522 of the engaging member 52 extends into the track groove 411 of the frame arm (i.e., the engaging member 52 is disengaged from the frame arm 41). At this time, the user can smoothly rotate the frame arm 41 to adjust the included angle between the frame arm 41 and the handle portion 22 so as to meet the operational requirement. Referring to FIG. 4 again, because the second sensor 62 co-moves with the positioning member 51, the second sensor 62 is separated from the first sensor 61, and the first and second sensors 61, 62 are converted into the first sensor state. At this time, the second sensor 62 generates the first signal (OFF), and the electrical control subunit 33 receives the first signal (OFF) and stops the electric power from being delivered to the motor 31. Consequently, the abrasive belt 42 is prevented from spinning.

Figure 15:
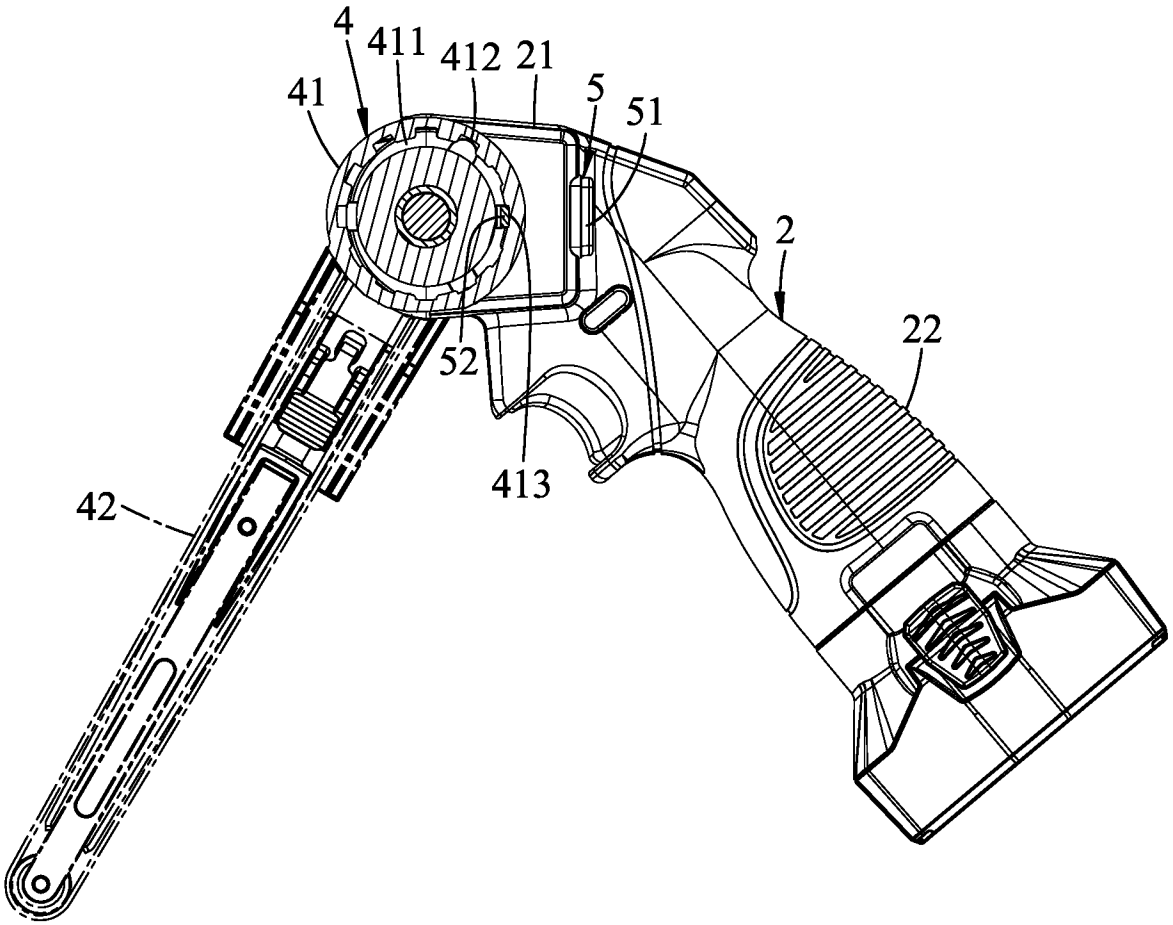
FIG. 15 is a view similar to FIG. 9, but illustrating that the engaging member extends into one of second notches of the frame arm.

Referring to FIGS. 14 and 16 again, and further to FIG. 15, when the frame arm 41 is rotated into the storage state, the engaging portion 522 of the engaging member 52 extends into a selected one of the second notches 413 of the frame arm 41 and the engaging member 52 engages the frame arm 41. At this time, the positioning member 51 is at the second engaging position, and the frame arm 41 is prevented from rotating relative to the main casing 2 by the engaging member 52. Specifically, referring to FIG. 4 again, when a user needs to convert the frame arm 41 from the working state into the storage state, the user presses against the pressing surface 511 of the positioning member 51 to push the positioning member 51 from the first engaging position to the releasing position along the second axis (Y). At this time, the second sensor 62 co-moves with the positioning member 51 and is separated from the first sensor 61. The first and second sensors 61, are converted into the first sensor state, and the second sensor 62 generates the first signal (OFF). The electrical control subunit 33 receives the first signal (OFF) and stops the electric power from being delivered to the motor 31. Consequently, the abrasive belt 42 is prevented from spinning, and the user can rotate the frame arm 41 from the working state into the storage state. Then, as the user releases the pressing surface 511 of the positioning member 51, the positioning member 51 moves from the releasing position to the second engaging position along the second axis (Y).

Figure 17:
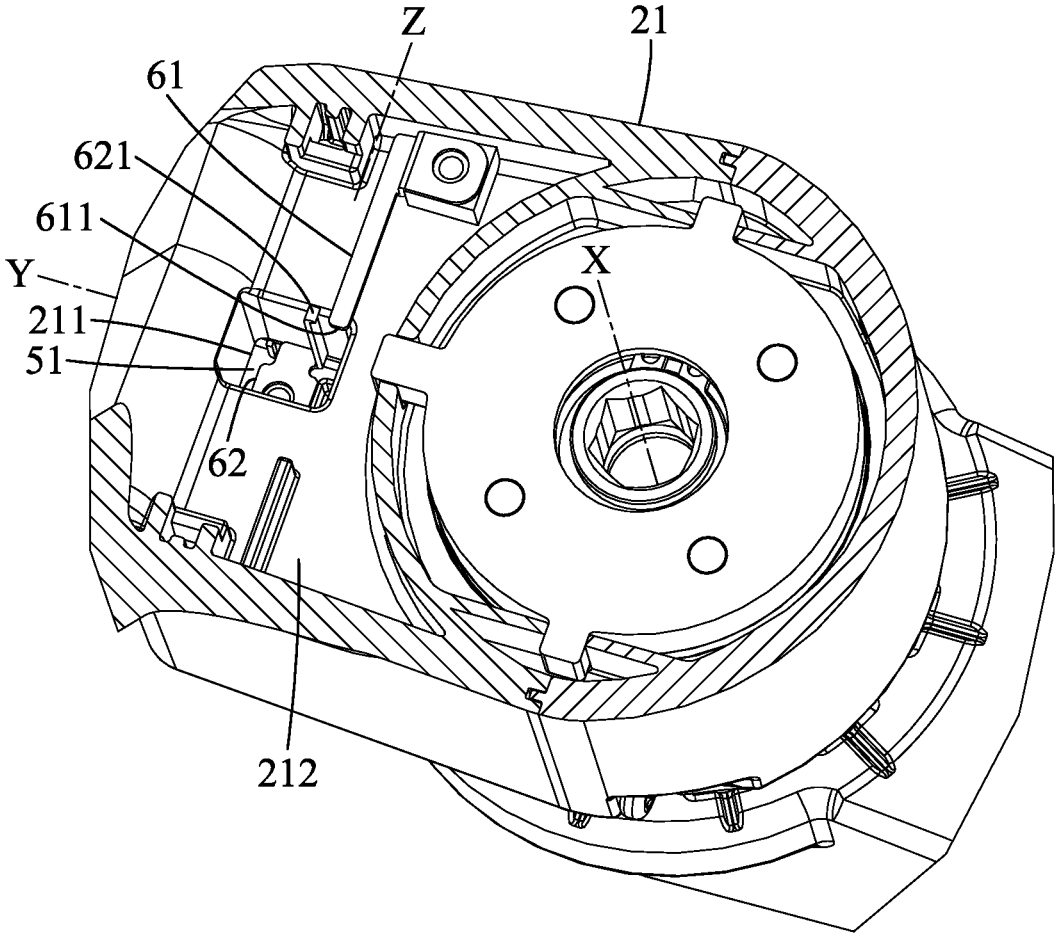
FIG. 17 is a view similar to FIG. 10, illustrating the second sensor being separated from a modification of the first sensor.
Figure 18:
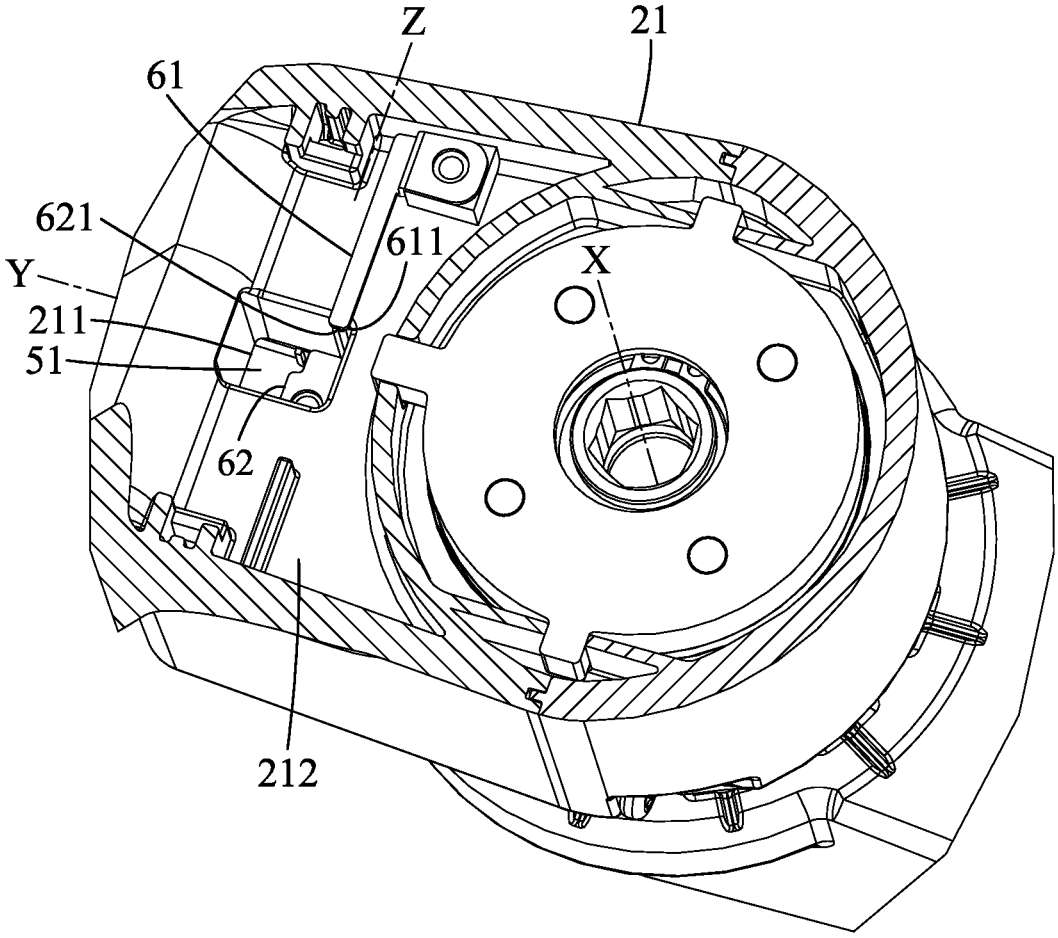
FIG. 18 is a view similar to FIG. 13, but illustrating that the second sensor is in contact with the modification of the first sensor.
Figure 19:
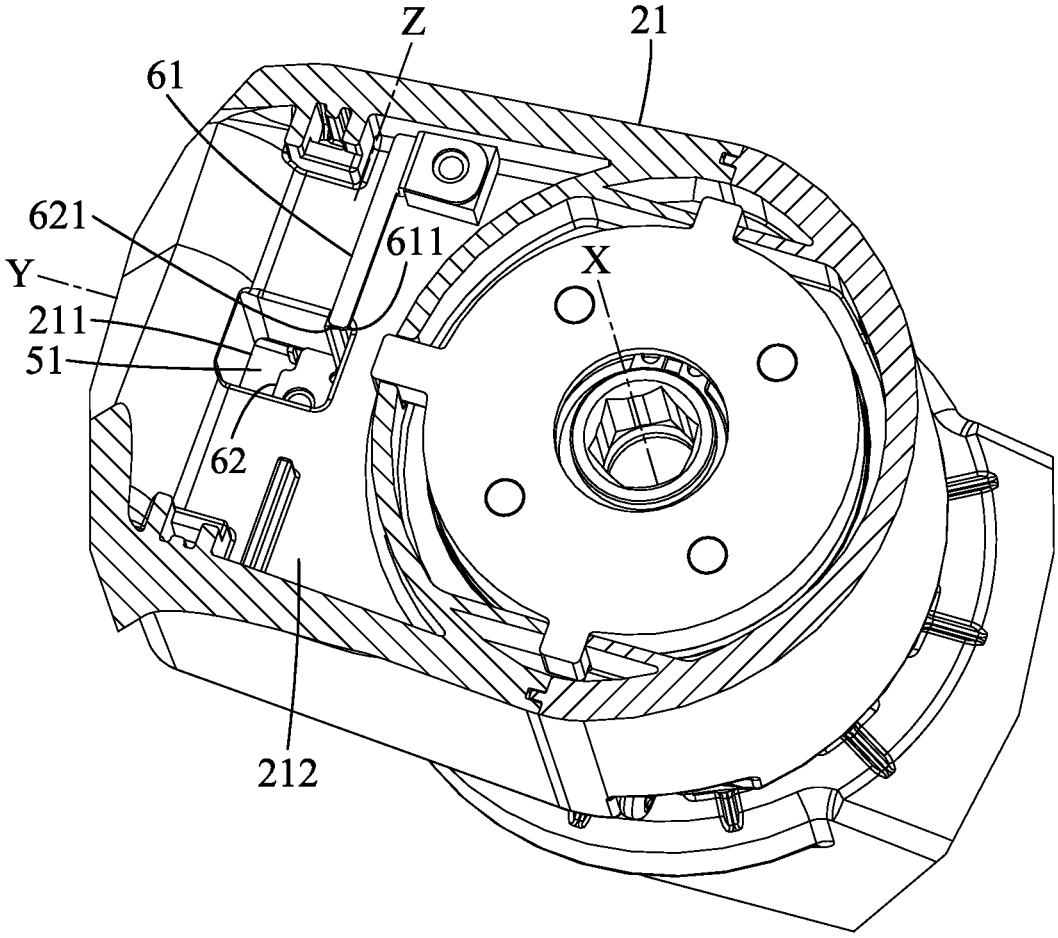
FIG. 19 is a view similar to FIG. 16, but illustrating that the second sensor is in contact with the modification of the first sensor.

It is noted that, the abovementioned first sensor state and the first signal (OFF) generated by the second sensor 62 are not limited to the condition where the sensor surface 621 of the second sensor 62 is separated from the sensor surface 611 of the first sensor 61. The abovementioned second sensor state and the second signal (ON) generated by the second sensor 62 are not limited to the condition where the sensor surface 621 of the second sensor 62 is in contact with the sensor surface 611 of the first sensor 61. Referring further to FIGS. 17 to 19, in a modification of the embodiment, the first sensor 61 is configured to be closer to the first axis (X) and the dimension of the sensor surface 611 thereof in the direction of the second axis (Y) is configured to be larger. In this modification, when the sensor surface 621 of the second sensor 62 is in contact with the sensor surface 611 of the first sensor 61, the first and second sensors 61, 62 are in the first sensor state, and the second sensor 62 generates the first signal (OFF). When the sensor surface 621 of the second sensor 62 is in separated from the sensor surface 611 of the first sensor 61, the first and second sensors 61, 62 are in the second sensor state, and the second sensor 62 generates the second signal (ON).

In summary, the embodiment of the belt sander has several benefits as follows.

By virtue of the positioning member 51 being mounted to the main casing 2 with the pressing surface 511 disposed adjacent to the handle portion of the main casing 2, the user is allowed to operate the positioning member 51 while gripping the handle portion 22 with only one hand, and at the same time, his/her other hand can be used to rotate the belt casing 41 of the belt unit 4, resulting in a smoother and more convenient operating process compared to the prior art.

By virtue of the first sensor 61 being mounted to the main casing 2, and by virtue of the second sensor 62 being connected to the positioning member 51 that is mounted to the main casing 2, no matter which angular position the frame arm 41 is at, the first sensor 61 and the second sensor 62 are convertible between the first sensor state and the second sensor state. That is to say, unlike the conventional hand-held belt sander 1 mentioned in the background that only cuts off the electric power when the arm 12 is rotated to a specific position relative to the casing 11, the embodiment of the belt sander is operable to cut off the electric power no matter where the frame arm 41 is rotated. When the frame arm 41 is positioned in the storage state, the positioning member 51 is at the second engaging position and the electric power is cut off. When the frame arm 41 is positioned in the working state, as long as a user moves the positioning member 51 from the first engaging position to the releasing position, the electric power can be cut off as well. The electric power can be cut off when the frame arm is in any one of the storage state and the working state, and thus a user's safety while adjusting the angular position of the frame arm 41 is guaranteed.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A belt sander comprising:

a main casing;

a belt unit including a frame arm that is rotatably connected to said main casing, and an abrasive belt that is mounted to said frame arm and that is adapted to be driven by electric power;

a positioning unit including a positioning member that is movably mounted to said main casing, and an engaging member that is co-movably connected to said positioning member, said positioning member being movable relative to said main casing between a first engaging position, where said engaging member engages said frame arm such that said frame arm is prevented from rotating, and a releasing position, where said engaging member is disengaged from said frame arm such that said frame arm is allowed to rotate; and a sensor unit including a first sensor that is mounted to said main casing, and a second sensor that is connected to one of said positioning member and said engaging member, and that is co-movable with said one of said positioning member and said engaging member relative to said first sensor, said first and second sensors being convertible between a first sensor state and a second sensor state;

each of said first sensor and said second sensor of said sensor unit has a respective sensor surface;

wherein, when said positioning member is at the releasing position, said first and second sensors are in the first sensor state, and said second sensor generates a first signal for ceasing the electric power;

wherein, when said positioning member is at the first engaging position, said first and second sensors are in the second sensor state, and said second sensor generates a second signal for conducting the electric power;

said sensor surface of said second sensor is in contact with said sensor surface of said first sensor when said first and second sensors are in one of the first sensor state and the second sensor state; and said sensor surface of said second sensor is separated from said sensor surface of said first sensor when said first and second sensors are in the other one of the first sensor state and the second sensor state.

2. The belt sander as claimed in claim 1, further comprising a power unit that is mounted to said main casing, and that includes:

a motor including an annular portion that surrounds a first axis and that extends out of said main casing, said frame arm of said belt unit being rotatably coupled to said annular portion, and a rotating shaft that drives said abrasive belt of said belt unit to spin by the electric power;

a trigger subunit electrically coupled to said motor, and adapted for manual operation so as to generate a trigger signal; and an electrical control subunit electrically coupled to said first sensor and said second sensor of said sensor unit and said trigger subunit for receiving the trigger signal, the first signal and the second signal, said electrical control subunit stopping the electric power from being delivered to said motor when receiving the first signal, and allowing the electric power to be delivered to said motor when receiving the second signal and the trigger signal.

3. The belt sander as claimed in claim 2, wherein:

said main casing includes a main portion that has a channel extending along a second axis which is substantially perpendicular to the first axis from an outer surface of said main portion to an inner surface of said main portion, and a handle portion that is transversely connected to said main portion;

said motor, said electrical control subunit of said power unit, and said positioning unit are mounted to said main portion;

said trigger subunit is mounted to said handle portion;

said positioning member of said positioning unit is disposed in said channel, is movable relative to said main casing along the second axis between the first engaging position and the releasing position, and has a pressing surface that is exposed from said channel for manual operation.

4. The belt sander as claimed in claim 3, wherein said main portion of said main casing further has a mounting surface spaced apart from said belt unit, said first sensor being mounted to said mounting surface and being adjacent to said channel of said main portion.

5. The belt sander as claimed in claim 3, wherein said first sensor of said sensor unit is elongated along a third axis substantially perpendicular to the first axis and the second axis, said sensor surface of said first sensor facing said channel of said main casing, said second sensor of said sensor unit being elongated in the direction of the first axis.

6. The belt sander as claimed in claim 3, wherein said positioning member of said positioning unit is elongated along the second axis, said engaging member of said positioning unit being elongated in the direction of the first axis.

7. The belt sander as claimed in claim 3, wherein said handle portion of said main casing extends from said outer surface of said main portion of said main casing and is adjacent to said channel.

8. The belt sander as claimed in claim 2, wherein:

said frame arm is rotatable relative to said main casing between a working state, in which a shortest distance between said abrasive belt thereof and said trigger subunit of said power unit is no less than a safety length, wherein said safety length ranges from 70 to 90 millimeters, and a storage state, in which the shortest distance between said abrasive belt and said trigger subunit is smaller than the safety length;

said positioning member of said positioning unit is movable relative to said main casing among the releasing position, the first engaging position, and a second engaging position;

when said positioning member is at the releasing position, said frame arm is allowed to rotate relative to said main casing;

when said positioning member is at the first engaging position, said frame arm is positioned in the working state and is prevented from rotating;

when said positioning member is at the second engaging position, said engaging member engages said frame arm such that said frame arm is positioned in the storing state and is prevented from rotating, said first and second sensors are in the first sensor state, and said second sensor generates the first signal for ceasing the electric power.

9. The belt sander as claimed in claim 8, wherein said main casing includes a main portion and a handle portion that is transversely connected to said main portion, said positioning unit being mounted to said main portion.

10. The belt sander as claimed in claim 9, wherein:

said frame arm of said belt unit is formed with a track groove that opens toward said main casing and that surrounds the first axis, and a plurality of first notches and a plurality of second notches that are arranged around said track groove and that are in spatial communication with said track groove;

when said positioning member of said positioning unit is at the releasing position, said engaging member of said positioning unit extends into said track groove, and said frame arm is allowed to rotate between the working state and the storage state;

when said positioning member is at the first engaging position, said engaging member extends into a selected one of said first notches such that said frame arm is positioned in the working state; and when said positioning member is at the second engaging position, said engaging member of said positioning unit extends into a selected one of said second notches, such that said frame arm is positioned in the storage state.

11. The belt sander as claimed in claim 10, wherein:

said engaging member has a connection portion, and an engaging portion that is opposite to said connection portion;

said engaging portion extends into said track groove, the selected one of said first notches and the selected one of said second notches of said belt unit when said positioning member is at the releasing position, the first engaging position, and the second engaging position, respectively; and said positioning unit further includes a bolt that extends through said connection portion of said engaging member and that fastens said engaging member to said positioning member.

12. The belt sander as claimed in claim 1, wherein said positioning unit further includes at least one resilient member that is disposed between and abuts against said positioning member and said main casing for biasing said positioning member away from the releasing position.

* * * * *